United States Patent [19]

Schwartz

[11] Patent Number: 4,611,266

[45] Date of Patent: Sep. 9, 1986

[54] REFRACTOR FOR ELECTRIC LIGHT WALL UNIT

[75] Inventor: Frederic W. Schwartz, Providence, R.I.

[73] Assignee: Cable Electric Products, Inc., Providence, R.I.

[21] Appl. No.: 756,542

[22] Filed: Jul. 19, 1985

[51] Int. Cl.[4] ..... F21V 5/02

[52] U.S. Cl. ..... 362/226; 362/311; 362/340

[58] Field of Search ..... 362/311, 226, 353, 455, 362/336, 340, 355, 361, 326; D26/26, 118

[56] References Cited

U.S. PATENT DOCUMENTS

D. 274,369 6/1984 Schwartz ..... D26/26

2,075,364 3/1937 Smith ..... 362/226

*Primary Examiner*—William A. Cuchlinski, Jr.

*Assistant Examiner*—Diana M. Cox

*Attorney, Agent, or Firm*—Paul J. Sutton

[57] ABSTRACT

The invention features a reflector for an electric bulb wall unit that diffuses and spreads the light over a wider area. The body of the reflector has a light diffusing semi-cylindrical center surface containing many diamond-studded projections. Surrounding the center surface are quarterly-spherical surfaces having saw-toothed striations that diffuse and spread the light in arcuate pathways.

8 Claims, 6 Drawing Figures

REFRACTOR FOR ELECTRIC LIGHT WALL UNIT

FIELD OF THE INVENTION

The invention relates to light bulb refractors, and more particularly to a refractor for an electric light wall unit.

BACKGROUND OF THE INVENTION

Electric light wall units feature many kinds of refractive devices. Some refractors comprise nothing more than translucent plates; a decorative covering; or a housing to prevent the heat of the electric bulb from scorching the wall.

Most night light wall units use low wattage bulbs of about 7 to 15 watts. Such units cast very little light across the room, and therefore, illuminate only a small area in the general vicinity of the wall unit.

It is one object of the present invention to provide an electric light wall unit with a refractive housing which will maximize the area illuminated by the electric bulb.

The refractor of this invention features a light transmissive one-piece body that diffuses and spreads the light over a wider area of the room.

The refractor of the invention has a center section having a surface with a semi-cylindrical shape, which surface has many hundreds of tiny diamond-studded projections. Light impinging upon these tiny diamond projections is diffused and spread in an arc of 180° or more.

The upper and lower ends of the refractor comprise quarterly-spherical surface sections having saw-toothed striations radially emanating from the center point of the demarcation of the cylindrical section and the quarterly-spherical sections. These saw-toothed striations act to spread and fan the light in perpendicular arcs of 180° or more above and below the wall unit.

Thus, the refractor of this invention has the capability of casting a wide angle of light in a three dimensional sense, i.e. light is cast in several planar directions across the room.

The uniqueness of the rounded surfaces of the housing and the many interior projections therein, serves to magnify, and enhance the spread of the light produced from the electrical light unit.

Thus, the present invention provides a novel refractor that serves to make efficient use of the generated low wattage light.

BRIEF SUMMARY OF THE INVENTION

The invention pertains to a light refractor for a plug-in light wall unit. The refractor comprises a light transmissive body having a plurality of textured surface sections having light diffusing patterns disposed thereon. A first surface section features a semi-cylindrical diamond-studded textured pattern.

A pair of quarterly-spherical surface sections border the semi-cylindrical surface section along a curved demarcation therebetween. The quarterly-spherical surface sections have saw-tooth striations radially extending from a center point of the curved demarcation.

The remaining oval-shaped rear reflector surface also contains saw-toothed striations. The textured patterns of the various surface sections are disposed on the inside of the body, the outside thereof being substantially smooth.

The inside of the refractor contains a bracket disposed approximately one-third the distance along the diamond-studded semi-cylindrical surface section.

The bracket is a support for an electric light base.

It is an object of this invention to provide an improved refractor for an electric light wall unit;

It is another object of the invention to provide a refractor for an electric light wall unit that diffuses and spreads the light in multi-dimensional arcs.

DETAILED DESCRIPTION OF THE INVENTION

Figure 1:
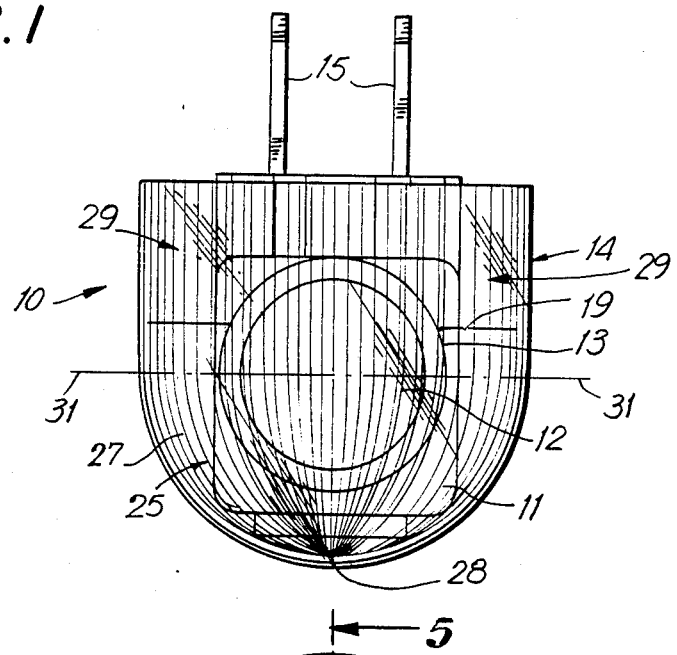
FIG. 1 is a top view of an electric light wall unit utilizing the refractor of this invention.
Figure 2:
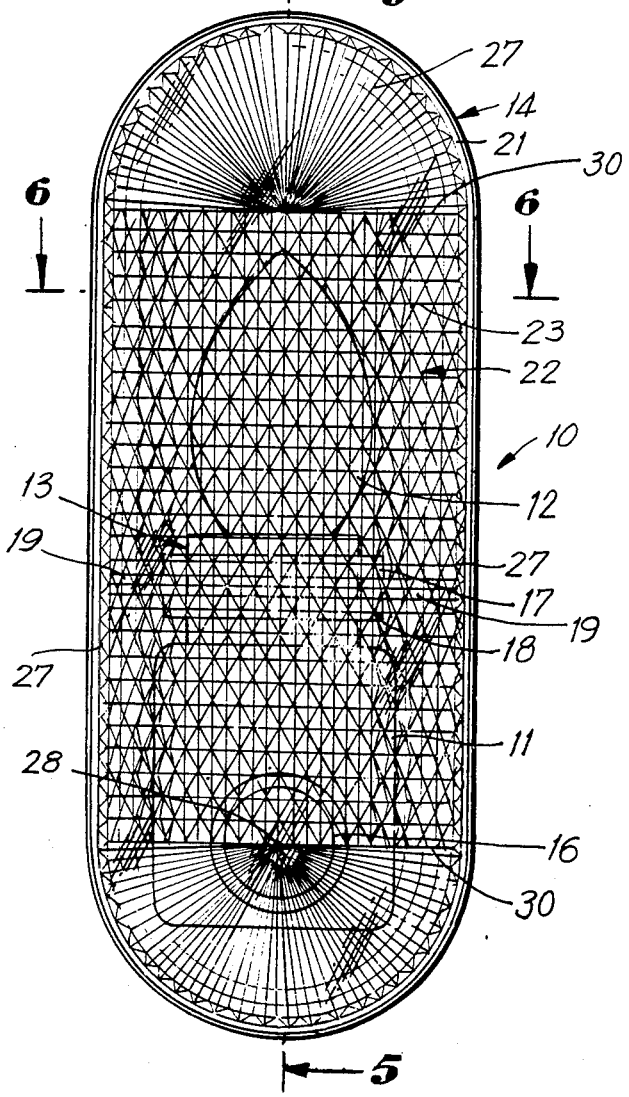
FIG. 2 is a front view of the electric light wall unit with the refractor of FIG. 1.

Generally speaking, the invention relates to a refractor for an electric light, plug-in wall unit that diffuses and spreads the light in several directions. By casting the light in several directions, the refractor has as its purpose to enhance the area of illumination.

Now referring to FIGS. 1–6, an electric light wall unit 10 is shown having a plug-in base 11, an electric bulb 12 screwed into the base 11, and a collar 13 for attachment to the back of the refractor 14 of this invention.

The base 11 has two prongs 15 for insertion into a wall outlet (not shown). The prongs 15 electrify the base 11, which supplies power to light the electric bulb 12. At the front end of base 11, an optional electric eye switch 16 (FIG. 2) is located to supply power to bulb 11, when the room becomes dark.

The collar 13 has two flanges 17 and 18 which slide into a bracket 19 located at the back of the reflector 14.

Figure 5:
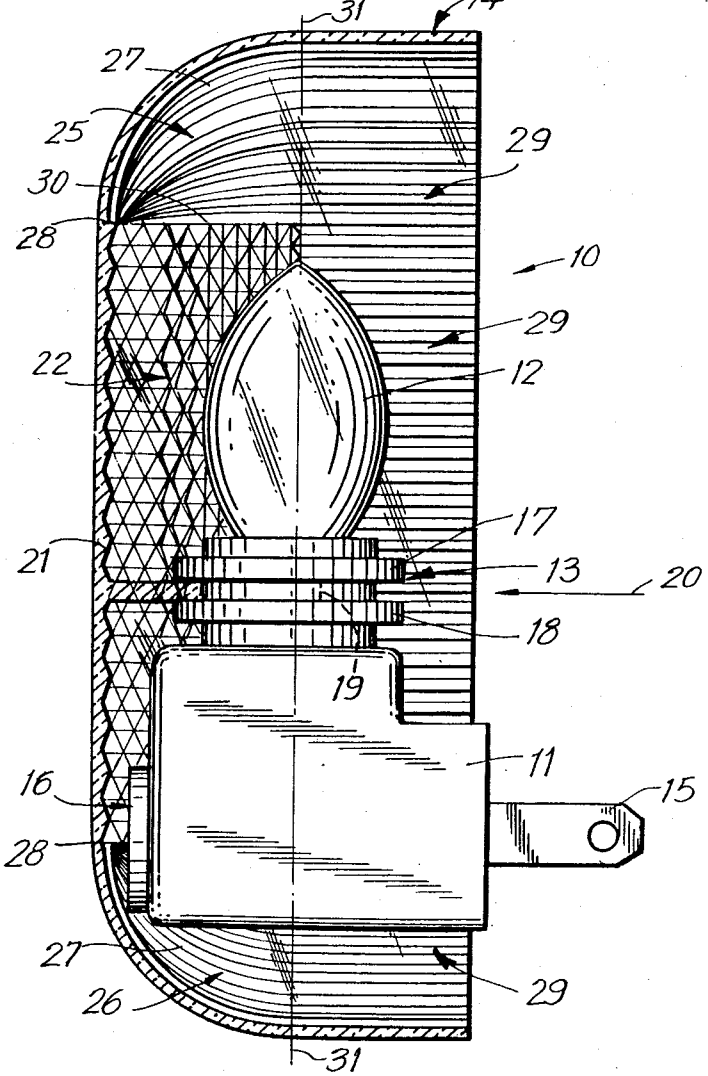
FIG. 5 is a sectional view taken along lines 5—5 of FIG. 2.

The bracket 19 comprises a thin plate that fits between flanges 17 and 18, respectively. A portion of the bracket 19 is cut out (not shown) to allow the insertion (arrow 20) of collar 13 (FIG. 5).

The refractor 14 of this invention comprises a rounded, hollow shell 21 of light transmissive plastic. Different inner surface sections of the shell 21 have textured patterns disposed therein to diffuse and spread the light generated from bulb 12. The outside of the shell 21 is generally smooth.

The unique refractive qualities of the refractor 14 are accomplished by means of the inner textured surface patterns.

The shell 21 is a one-piece construction; it generally being a one-piece molded member. However, for the purposes of describing the surface patterns within the shell 21, various surface sections will be delineated. A semi-cylindrical center section 22 has a knurled surface which comprises a multitude of tiny diamond-studded projections 23 (typical).

Figure 3:
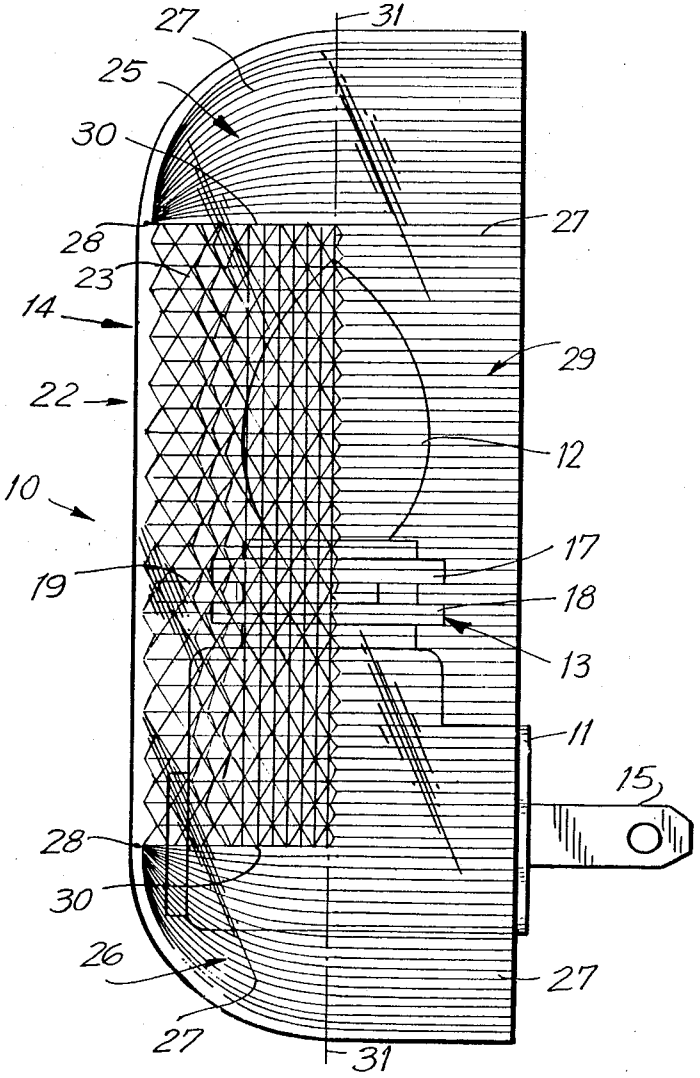
FIG. 3 is a side view of the electric light wall unit with the refractor of FIG. 1.
Figure 4:
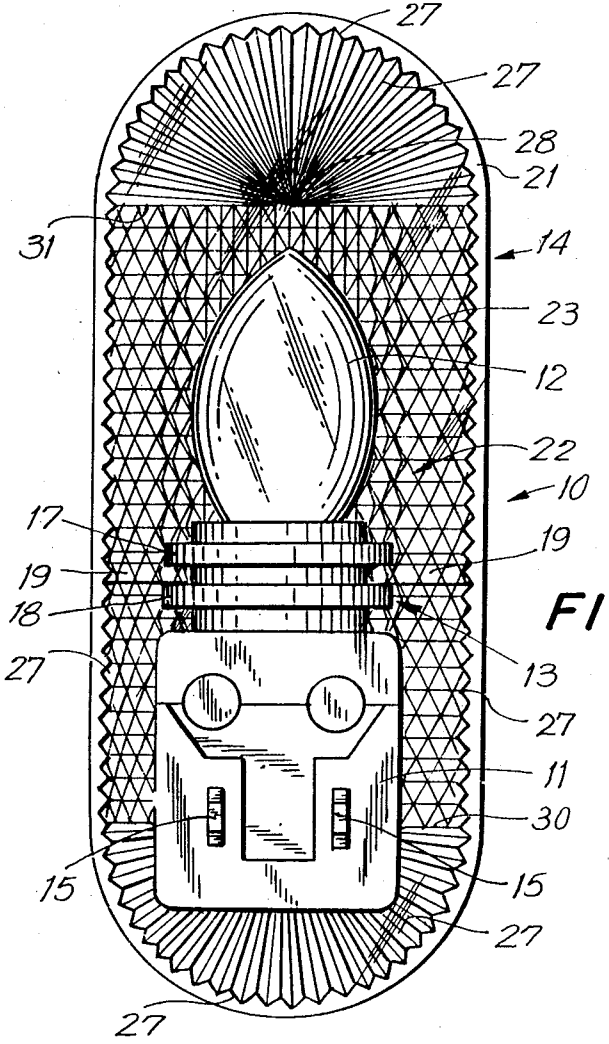
FIG. 4 is a back view of the electric light wall unit with the refractor of FIG. 1.
Figure 6:
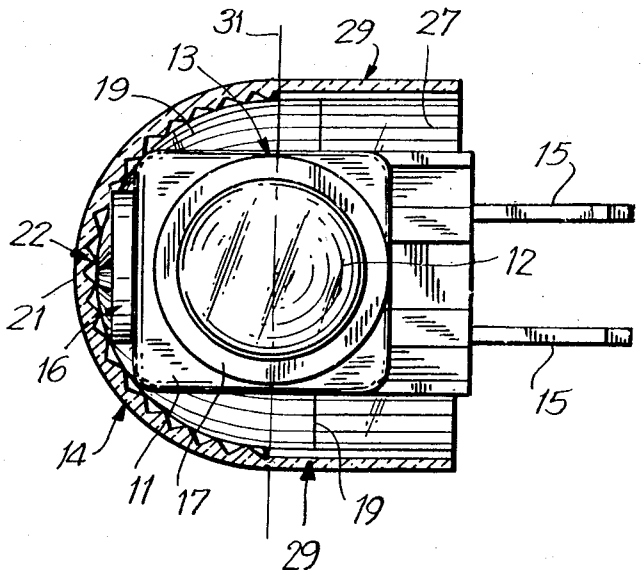
FIG. 6 is a sectional view taken along lines 6—6 of FIG. 2.

The semi-cylindrical surface section 22 of shell 21 covers the front of the base 11 and bulb 12 as best seen in FIG. 3.

Two quarterly-spherical sections 25 and 26 are disposed above and below the semi-cylindrical section 22 above line 30 and before line 31, seen in FIGS. 3 and 5. The quarterly-spherical sections 25 and 26, each have saw-toothed striations 27 (typical) disposed therein. The striations 27 radially project from a center point 28 located on the curved demarcation line 30 between the semi-circular surface section 22 and the quarterly-spherical surface sections 25 and 26, respectively.

The saw-toothed striations 27 are also disposed all about a rear surface portion 29 of the reflector 14. The rear surface portion 29 comprises an oval-shaped area generally behind line 31 that borders the sections 22, 25 and 26, as illustrated in FIGS. 1, 3 and 5.

The diamond-studded projections 23 and the saw-toothed striations 27 cause the light generated by bulb 12 to be diffused and spread arcuately over a wide area surrounding the wall unit 10.

Having thus described the invention, what is desired to be protected by Letters Patent is presented in the subsequently appended claims.

What is claimed is:

1. A light refractor for a plug-in, electric light wall unit, comprising a light transmissive body having a plurality of surface sections having light diffusing patterns thereon, including:

a semi-cylindrical surface having a diamond-studded type of texture; and a pair of quarterly-spherical surfaces respectively bordering upon said semi-cylindrical surface and having saw-toothed type striations substantially radiating from a center point upon a demarcation between said quarterly-spherical surfaces and said semi-cylindrical surface.

2. The light refractor of claim 1, wherein said diamond studded type of surface and said saw-toothed type striations are disposed upon an inner portion of said body.

3. The light refractor of claim 1, further comprising a bracket extending from an inner portion of said body for supporting an electrical light base.

4. The light refractor of claim 3, wherein said bracket is disposed approximately one-third a distance along said semi-cylindrical section.

5. In combination with the refractor of claim 1, a bracket attached to said body and supporting an electric light base.

6. The light refractor of claim 1, wherein an outer portion of said body is substantially smooth.

7. The light refractor of claim 1, further comprising an oval-shaped rear surface section bordering said semi-cylindrical and quarterly-spherical surfaces.

8. The light refractor of claim 7, wherein said oval-shaped rear surface comprises saw-toothed type stirations.

* * * * *